US009694955B2

(12) United States Patent
Wu et al.

(10) Patent No.: US 9,694,955 B2
(45) Date of Patent: Jul. 4, 2017

(54) UNITARY CHILD-RESISTANT CONTAINERS CONFIGURED FOR ATTACHMENT TO IDENTIFIER CAP, AND IDENTIFIER CAP

(71) Applicant: KUSH BOTTLES, INC., Santa Ana, CA (US)

(72) Inventors: Ben Wu, Culver City, CA (US); Brian R. Johnson, Jr., Huntington Beach, CA (US)

(73) Assignee: Kush Bottles, Inc., Santa Ana, CA (US)

( * ) Notice: Subject to any disclaimer, the term of this patent is extended or adjusted under 35 U.S.C. 154(b) by 117 days.

(21) Appl. No.: 14/567,272

(22) Filed: Dec. 11, 2014

(65) Prior Publication Data

US 2016/0167844 A1 Jun. 16, 2016

(51) Int. Cl.

| | |
|---|---|
| ***B65D 50/00*** | (2006.01) |
| ***B65D 43/16*** | (2006.01) |
| ***B65D 51/24*** | (2006.01) |
| ***B65D 43/02*** | (2006.01) |

(52) U.S. Cl.

CPC ..... *B65D 50/00* (2013.01); *B65D 43/021* (2013.01); *B65D 43/162* (2013.01); *B65D 51/245* (2013.01); *B65D 2215/06* (2013.01); *B65D 2543/00092* (2013.01); *B65D 2543/00296* (2013.01); *B65D 2543/00518* (2013.01); *B65D 2543/00546* (2013.01); *B65D 2543/00925* (2013.01)

(58) Field of Classification Search

CPC .. B65D 2203/00; B65D 81/366; B65D 51/24; B65D 43/021; B65D 43/162; B65D 50/00; B65D 51/245; B65D 2215/06; B65D 2543/00092; B65D 2543/00296; B65D 2543/00518; B65D 2543/00546; B65D 2543/00925

USPC ..... 215/227, 230, 209; 220/729

See application file for complete search history.

(56) References Cited

U.S. PATENT DOCUMENTS

| | | | | | |
|---|---|---|---|---|---|
| 2,046,745 | A | * | 7/1936 | Hoag | B65D 51/245 15/143.1 |
| 3,628,686 | A | * | 12/1971 | Burton | B65D 55/16 138/89 |
| 4,022,218 | A | * | 5/1977 | Riddick | A61M 1/008 406/152 |
| 4,069,935 | A | | 1/1978 | Hampel | |
| 4,356,617 | A | * | 11/1982 | Coscia | B29C 31/042 118/315 |
| 4,556,588 | A | * | 12/1985 | Rockwood | B44C 5/005 428/13 |
| 4,750,457 | A | * | 6/1988 | Bonutti | B65D 1/0238 123/198 D |
| 5,025,941 | A | * | 6/1991 | Petit | B65D 51/18 215/227 |
| 5,115,930 | A | * | 5/1992 | Lohrman | B65D 47/0838 215/227 |
| 5,176,269 | A | * | 1/1993 | Herman | B65D 41/0492 215/228 |

(Continued)

*Primary Examiner* — Fenn C Mathew
*Assistant Examiner* — Madison L Poos
(74) *Attorney, Agent, or Firm* — Larry K. Roberts

(57) ABSTRACT

A mechanism or feature incorporated into or on the lid of a one piece child-resistant container which allows customization of the container by attachment of an independent, separate ancillary piece or identifier cap to the lid. The identifier cap may snap onto or be pushed onto the lid in a secure manner.

9 Claims, 7 Drawing Sheets

(56) References Cited

U.S. PATENT DOCUMENTS 5,180,072 A * 1/1993 Oehlert ..... B65D 55/02 206/1.5
5,284,263 A * 2/1994 Papciak ..... A61J 1/03 206/459.5
5,377,853 A 1/1995 Papciak
5,803,283 A 9/1998 Barker
5,967,350 A 10/1999 Jones
6,065,623 A * 5/2000 Hierzer ..... G09F 19/12 215/230
D494,856 S 8/2004 Hillard
7,275,642 B2 * 10/2007 Yuhara ..... A45D 40/222 206/1.5
D598,738 S * 8/2009 Supranowicz ..... D9/420
8,028,446 B2 10/2011 Moran
8,286,812 B2 * 10/2012 Buczkowski ..... B65D 51/245 215/219
8,426,000 B2 4/2013 Harruff
8,555,471 B2 * 10/2013 Rojdev ..... 27/14
8,763,831 B2 7/2014 Garcia
9,327,876 B2 * 5/2016 Garcia ..... B65D 39/0052
2004/0216340 A1 11/2004 Woods
2005/0045642 A1 * 3/2005 Vance ..... B65D 51/32 220/521
2006/0186081 A1 8/2006 Reed
2007/0007228 A1 1/2007 Weed
2008/0190927 A1 8/2008 Bougoulas
2009/0020493 A1 1/2009 Yeager
2009/0090688 A1 4/2009 Fruchter
2009/0120897 A1 5/2009 Armenti
2009/0120898 A1 * 5/2009 Hunt ..... B65D 51/248 215/230
2010/0072099 A1 3/2010 Klein
2012/0138563 A1 6/2012 Brumfield
2014/0175044 A1 6/2014 Pryor
2015/0090623 A1 * 4/2015 Grabiner ..... B65D 51/245 206/459.1
2015/0366755 A1 * 12/2015 Milante ..... A61J 1/1425 215/203

* cited by examiner

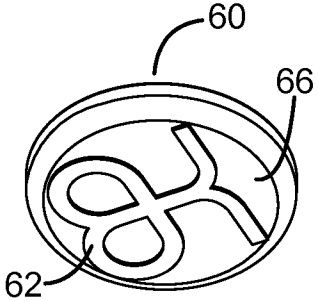
FIG. 4B
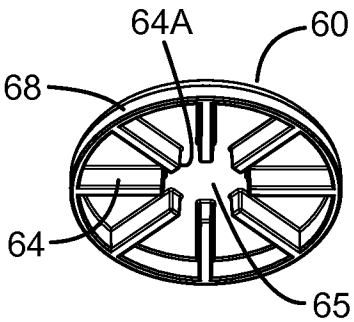
FIG. 4A
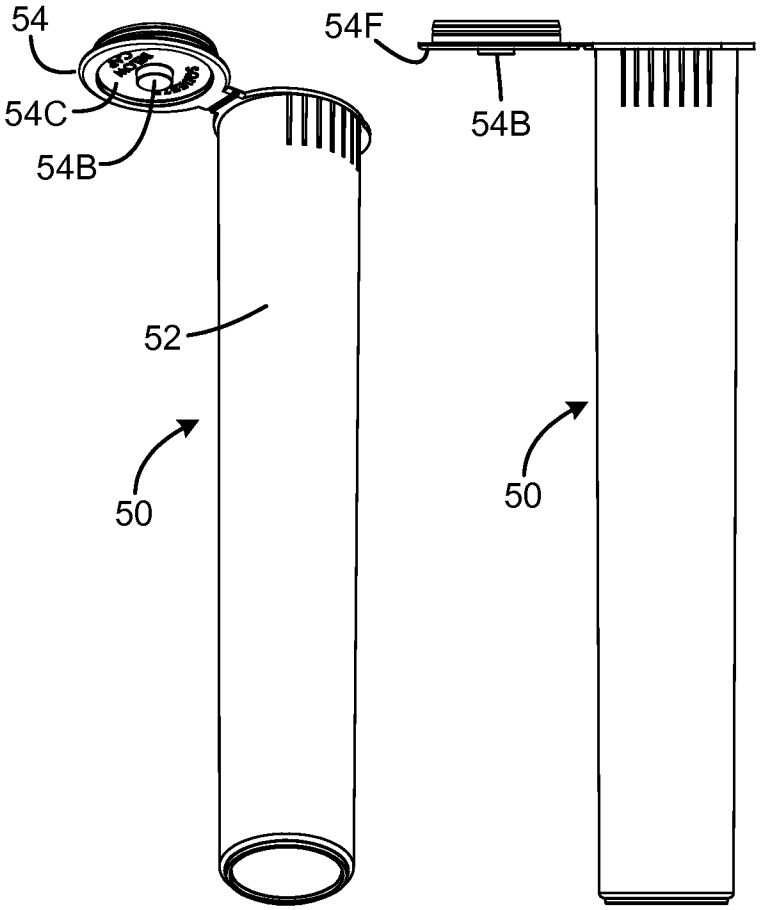
FIG. 3B
FIG. 3A

UNITARY CHILD-RESISTANT CONTAINERS CONFIGURED FOR ATTACHMENT TO IDENTIFIER CAP, AND IDENTIFIER CAP

BACKGROUND

One piece or unitary child-resistant vial containers have been utilized for quite some time. Compared to two piece child-resistant containers, which typically involve a push and turn or squeeze and turn function to open, one piece child-resistant containers typically involve a simpler squeeze to open mechanism. These vials are child resistant because their construction gives them a squeeze resistance that children simply don't have the grip strength to open.

One piece child-resistant vial containers are often referred to as "pop-tops", based on the sound they make when being opened due to the pressure and force resistance of the vial container.

Current one piece child resistant vial containers have a flat lid. Some lids have text on top, but the profile of these container lids are all relatively flat.

These vial containers are typically manufactured via injection molding and offer both an economic and functional advantage over traditional two piece child-resistant containers.

Due to limitations in plastic injection molding technology, it is much more expensive to manufacture a unitary child-resistant vial container in with a lid that has an intentional or specific color difference than the body of the container.

BRIEF DESCRIPTION OF THE DRAWINGS

Features and advantages of the disclosure will readily be appreciated by persons skilled in the art from the following detailed description when read in conjunction with the drawing wherein:

FIGS. 3A-3B are isometric views of the embodiment of FIGS. 1A-1B, without the identifier cap.

FIGS. 4A-4B are respective isometric views of the identifier cap of the embodiment of FIGS. 1A-1C.

DETAILED DESCRIPTION

Figure 1C:
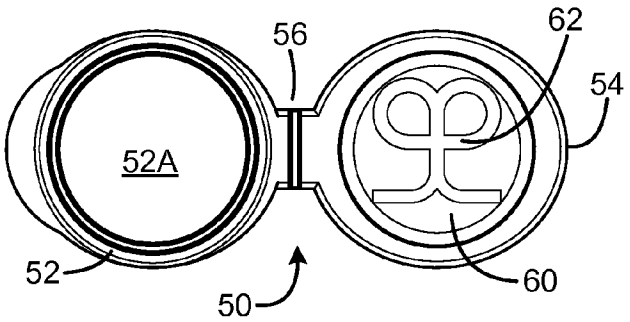
FIG. 1C is a closed end view of the container with the lid in an open position.

In the following detailed description and in the several figures of the drawing, like elements are identified with like reference numerals. The figures are not to scale, and relative feature sizes may be exaggerated for illustrative purposes.

To allow for simple, customization of the unitary child-resistant containers, in accordance with an exemplary embodiment of the invention, a unitary child-resistant container is provided that has a unique lid. This lid includes a protrusion feature onto which a plastic identifier cap can be securely attached. In an exemplary embodiment, the unitary child-resistant container (including the lid and protrusion) is manufactured with a plastic material such as polypropylene, while the identifier cap is manufactured using a firmer, more rigid plastic, such as a polycarbonate. In this exemplary embodiment, the protrusion on the lid is slightly wider in diameter than a receiver space feature on the bottom of the identifier cap. Because the identifier cap is made using a more rigid material, when pressed onto the protrusion of the lid, the protrusion will give way and fit tightly into the receiver space feature of the identifier cap. The container may typically be a single color part, fabricated by injection molding. The cap will also typically be a unitary part, and typically also a single color. In other embodiments, the cap and the container may be fabricated of the same material, or the container may be fabricated of a more rigid material than the cap.

Because the unitary child-resistant vial container opens via a "squeeze to open" mechanism, and because the "squeeze to open" mechanism requires exertion of considerable force (thus creating a popping sound when opening), there is risk that any piece attached to the lid may detach from the lid due to the violent opening action. To decrease the risk of detachment, the traditionally flat surface of the lid will be recessed slightly. By recessing the surface of the lid, a side wall is created, by which the edges of the identifier cap will be further secured to the lid.

Furthermore, by recessing the top of the lid, this allows the protrusion on the lid to be lengthened without compromising the child-resistance nature of the container. If the protrusion was too long, a child may be able to gain leverage against the protrusion and force the lid open.

FIGS. 1A-1C and 3A-6D illustrate an exemplary embodiment of a unitary child-resistant container 50, which includes a vessel portion 52 and a lid portion 54, connected by a living hinge 56. The vessel portion is generally tubular with a closed end 52A. The open end 52B of the vessel portion has a circumferential protrusion 52B1. The lid 54 has a circumferential groove 54A defined therein. The diameter of the bulge 54A1 defining one edge of the groove is selected, together with the groove diameter, in cooperation with the diameter of the protrusion 52B1 such that the bulge 54A1 has to slide over the protrusion 52B1 until the bulge is seated within the groove 54A, to snap the lid into place to close the open end 54 of the vessel. Since the diameter of the protrusion 52B1 is slightly larger than the outer diameter of the bulge 54A1, the lid is secured in place in the closed position.

Substantial force is required to open the container, by squeezing the vessel at opposing sides of the vessel adjacent the lid, at areas indicated at 52C and 52D. This is the "squeeze to open" mechanism or feature of the container 52. Because substantial force is required to open the container, it is typically capable of being classified as a child-resistant container.

In an exemplary embodiment, the container is modified to accept an identifier cap 60, which is securely fitted onto the lid portion 54. The cap in an exemplary embodiment includes a surface portion 66, with a downwardly extending skirt portion 68 at the periphery of the surface portion. An identifying indicia 62 such as a logo may be molded into or imprinted on the surface portion 66. The identifier cap 60 may be fabricated of a different color from the color of the container 50.

The modification to the container 50 in this exemplary embodiment is to lid portion 54, which incorporates a feature 54B which is configured for engagement with a corresponding feature, in this embodiment ribs 64 in the underside, of the identifier cap 60. As shown in FIG. 4A, for example, the ribs 64 extend from the skirt portion 68 radially inward, terminating in rib tips 64A short of the center of the cap.

In this exemplary embodiment, the feature 54B is a protrusion from the top surface 54C ("top" in the sense that the surface is exposed when the lid is in the closed position. The lid further differs from the conventional lid, to provide a recess 54D (FIG. 5F) in the lid, from which the feature 54B protrudes. The recess 54D is defined by peripheral wall 54E and the surface 54C. The depth of the recess 54D allows the protrusion to have a height extending above the surface 54C yet the entire vertical extent of the protrusion does not extend above the surface 54F, thus providing more surface area to engage the cap feature 64. The depth of the recess 54D allows the protrusion 54B to have more surface area to engage the cap feature 64 while partially shielding and reducing the amount of surface area that one could apply leverage against the protrusion 54B. In an exemplary embodiment, the recess 54D has a depth of 0.06 inch below the surface 54C, the protrusion 54B extends above the surface 54C by 0.06 inch, and above the surface 54F by 0.03 inch.

The feature 64 on the cap 60 is a series of radial ribs whose tips 64A terminate short of the center of the cap, such that the tips define a perimeter whose diameter is slightly smaller than a corresponding diameter of the protrusion 54B. In this embodiment, as noted above, the container 50 is fabricated of a plastic material such as polypropylene, while the identifier cap is manufactured using a firmer, more rigid plastic, such as a polycarbonate. In this embodiment, there are eight ribs 64, disposed at 45 degree radial spacing, and the distance between opposed rib tips is 0.191 inch at the top of the ribs, tapering to a 0.187 inch spacing at the base of the ribs. The diameter of the protrusion 54B in this example is 0.189 inch. The cap can be fitted onto the lid, with an interference fit between the protrusion 54B and the tips of the ribs securing the cap in position on the lid. In an exemplary embodiment, the cap 60 is secured to the lid only by the interference fit, and without the use of adhesive, which would increase cost through increased material and additional manufacturing processes.

The recess 54D in the lid also provides the advantage that the lateral joint between the bottom surface of the cap and the surface 54C of the lid is shielded from prying by the peripheral wall 54E, further assisting in securing the cap onto the lid. Further, the shield rigidifies the lid 54, also increasing the robustness of the connection between the lid and the cap against forces caused by opening the container by squeezing the vessel at the end adjacent the lid.

Figure 2B:
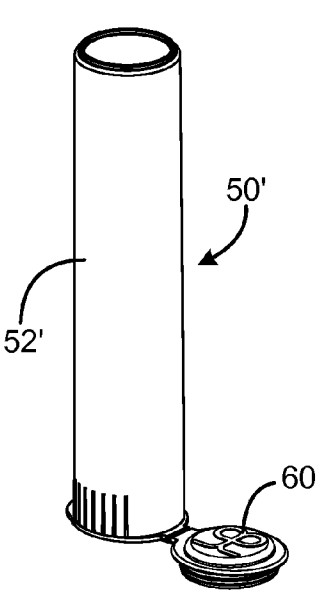
FIGS. 2A-2B are respective isometric views of an alternate embodiment of a child-resistant container, in which the container vessel is shorter than that of the embodiment of FIGS. 1A-1C.
Figure 2A:
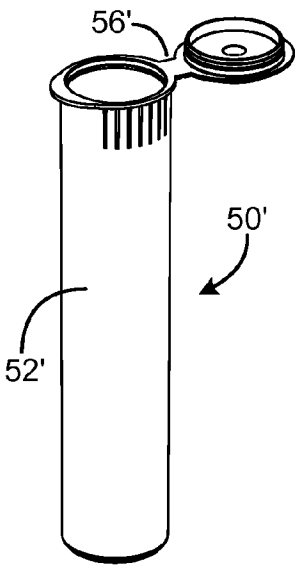
Figure 1B:
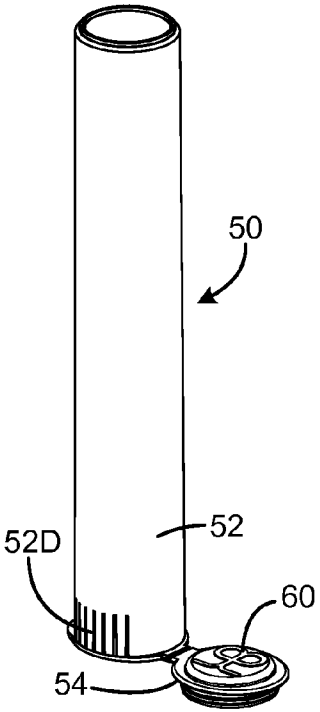
FIGS. 1A and 1B are respective isometric views of an exemplary embodiment of a child-resistant container with an identifier cap, and with the container lid in an open position.
Figure 1A:
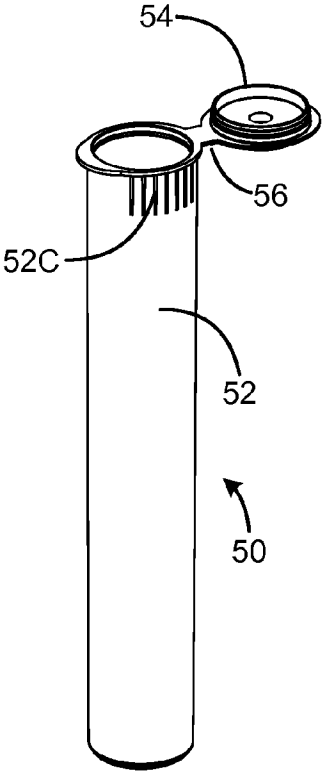
Figure 5A:
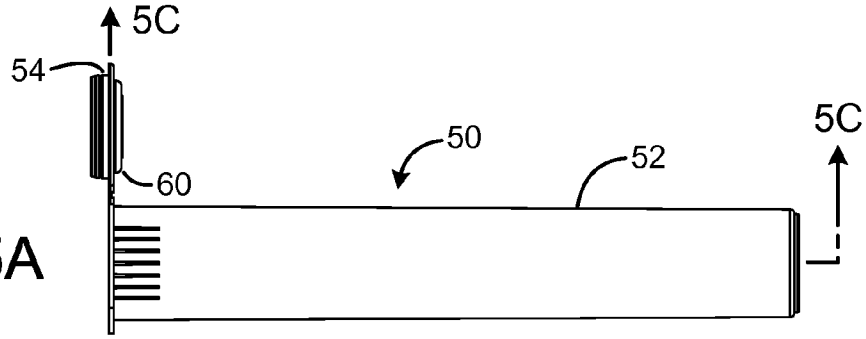
FIGS. 5A-5B are side views of the embodiment of FIGS. 1A-1C, with FIG. 5A showing the lid in an open position, and FIG. 5B showing the lid in the closed position.
Figure 5B:
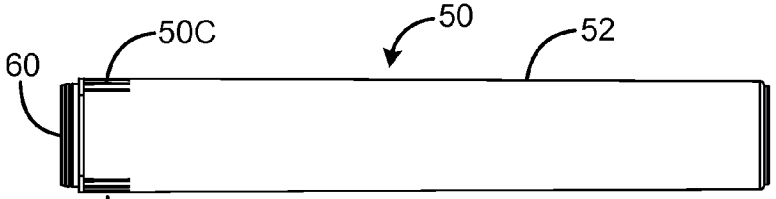
Figure 5C:
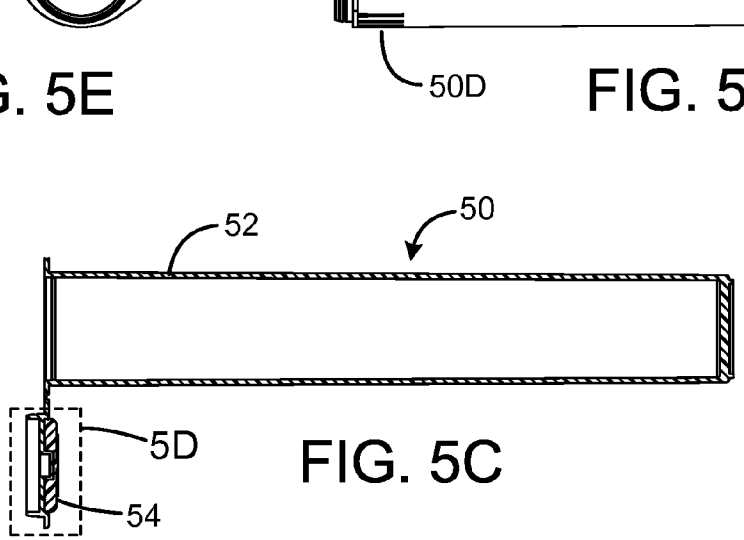
FIG. 5C is a cross-sectional view taken along line 5C-5C of FIG. 5A.
Figure 5D:
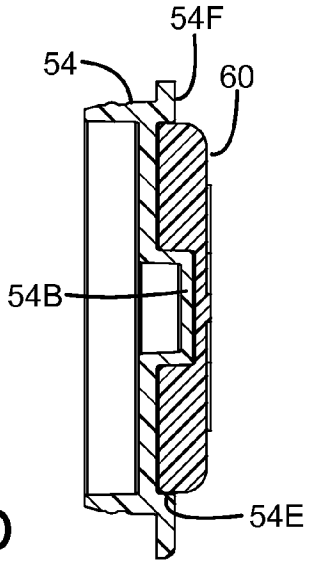
FIG. 5D is an enlargement of the portion of FIG. 5C within a dashed line box.
Figure 5E:
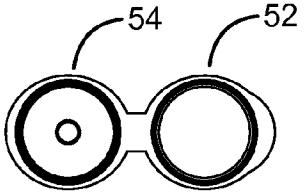
FIG. 5E is a top view of the container as in FIG. 5A.
Figure 5F:
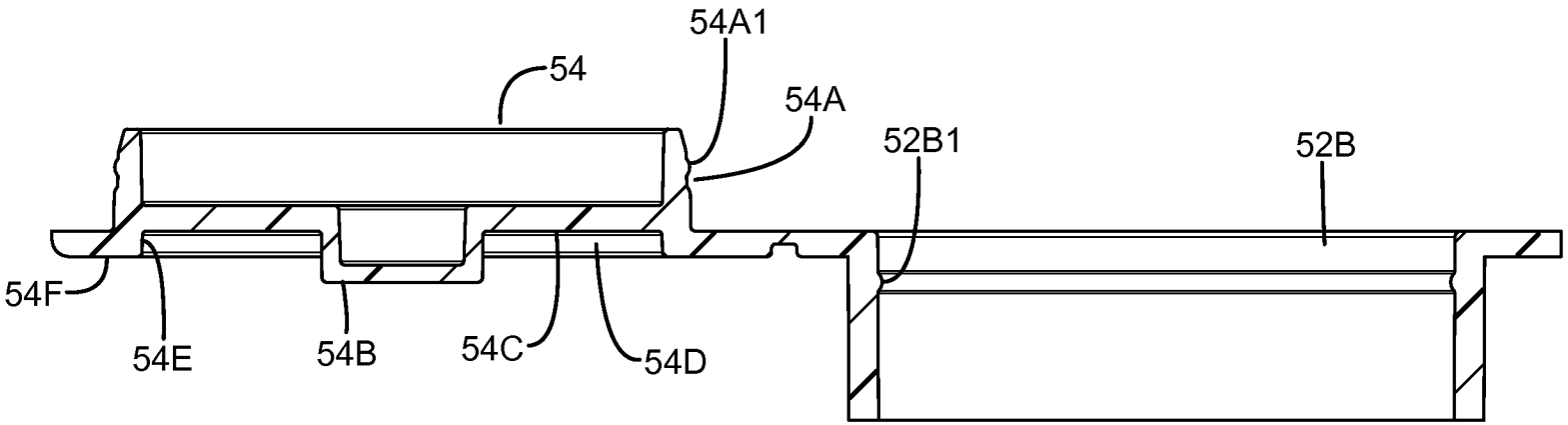
FIG. 5F is a cross-section showing the top of the vessel and the lid in an open position, without the identifier cap.
Figure 6D:
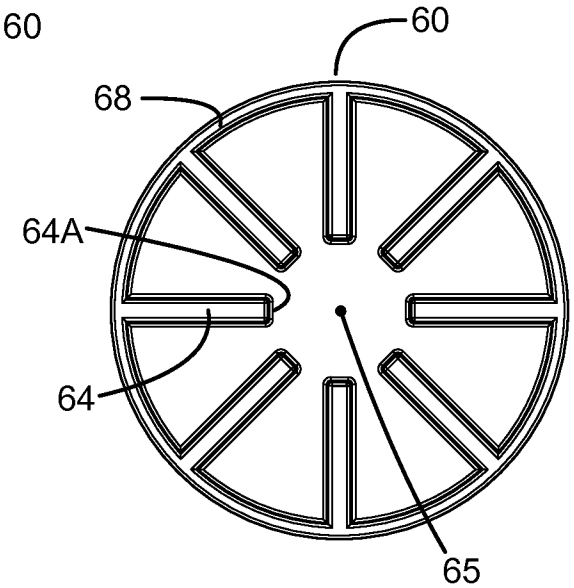
FIGS. 6A-6D illustrate an exemplary embodiment of the identifier cap of FIGS. 1-1C, with FIG. 6A a top view, FIG. 6B a cross-sectional view taken along line 6B-6B of FIG. 6A, FIG. 6C a side view, and FIG. 6D a bottom view.
Figure 6C:
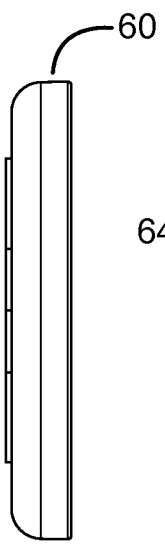
Figure 6B:
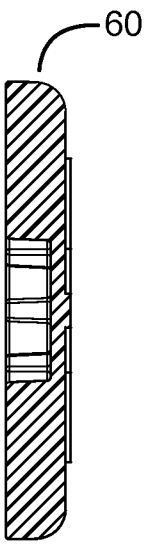
Figure 6A:
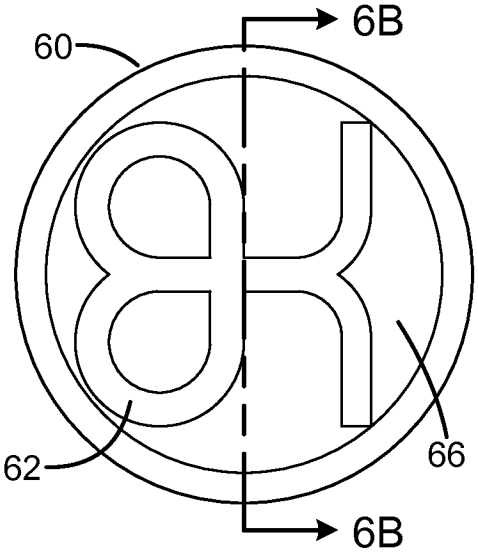

The vessel 52 can be of varying lengths. The embodiment 50' of FIGS. 2A-2B includes a shorter vessel than the vessel 52 of the embodiment of FIGS. 1A-1B.

In a general sense, this invention contemplates a mechanism or feature incorporated into or on the lid of a one piece child-resistant container which allows customization of the container by attachment of an independent, separate ancillary piece or identifier cap to the lid. The ancillary piece may snap onto or be pushed onto the lid in a secure manner.

Figure 7:
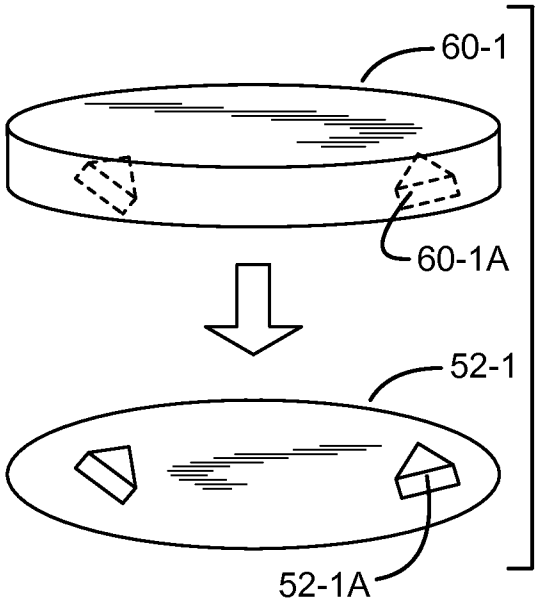
FIG. 7 illustrates an exemplary embodiment in which indentations are formed in the identification cap, and are configured to receive raised features extending from the lid.

The mechanism securing the ancillary piece to the lid may include a whole variety of designs. One exemplary design is illustrated in FIGS. 1A-6D. Generally as shown in those views, an indention or indentation in the cap is sized to couple with a protruding feature or features on the lid. The feature shapes could be any of a variety of shapes (triangular, round, etc.) FIG. 7 illustrates an embodiment in which indentations 60-1A are formed in the cap 60-1, and are configured to receive raised features 52-1A on the lid 52-1. An interference fit between the respective features secures the cap to the lid.

Figure 8A:
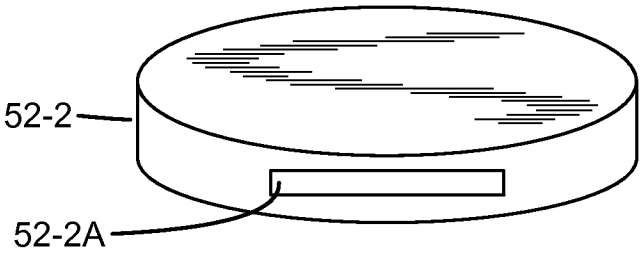
FIGS. 8A-8B illustrate an alternate embodiment in which the container lid has a slot formed in a lateral edge, and configured to receive a tail feature of the identification cap.
Figure 8B:
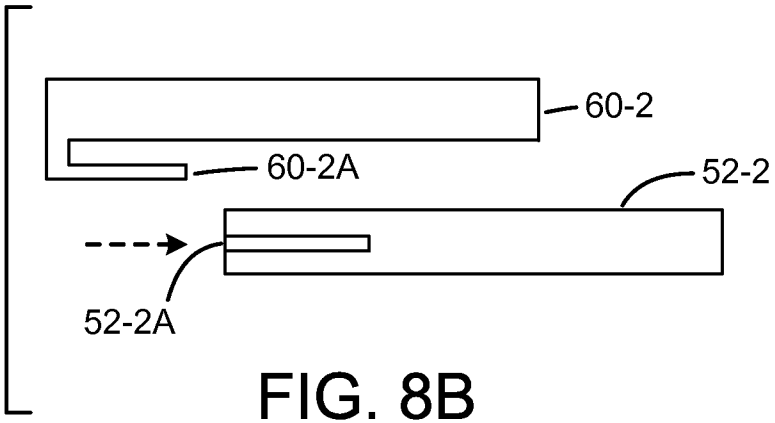
Figure 9:
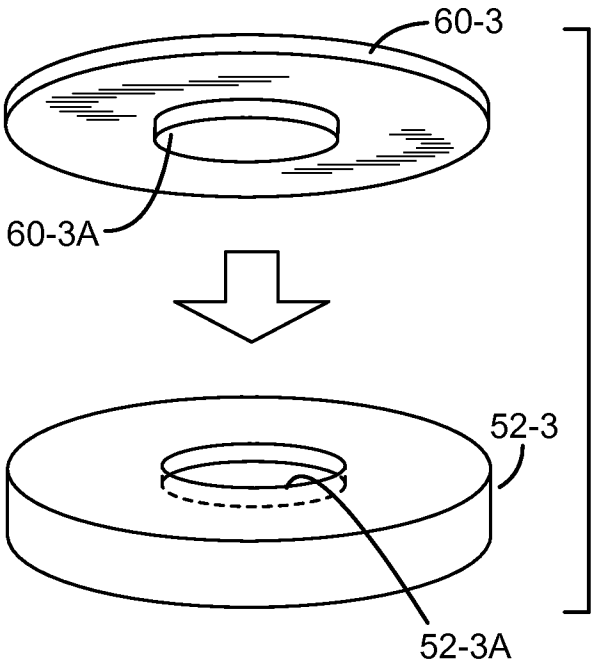
FIG. 9 illustrates another embodiment in which the cap has a protrusion which is received in a recess formed in the lid.

While a preferred, contemplated method for attachment of the identification cap is by snapping it onto the lid, there could be other mechanisms by which the two pieces are joined. FIGS. 8A-8B illustrate an alternate embodiment in which the container lid 52-2 has a slot 52-2A formed in a lateral edge. The slot is configured to receive a tail 60-2A of the identification cap 60-2, which slides into the slot to secure the cap to the lid. In another embodiment, illustrated in FIG. 9, the cap 60-3 has a protrusion 60-3A, which is received in a recess 52-3A formed in the lid 52-3.

Figure 10:
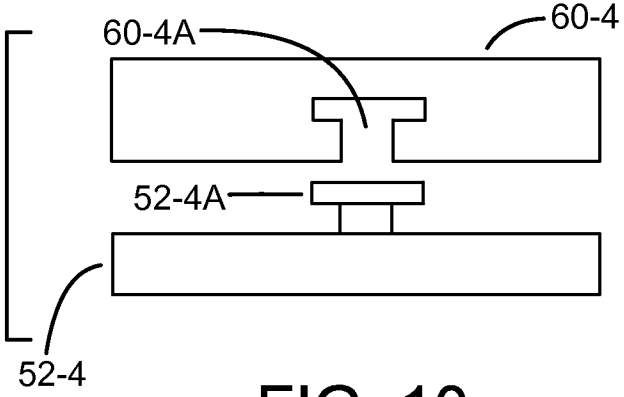
FIG. 10 illustrates a further embodiment, in which an identification cap has a recess formed into a lateral edge and bottom surface of the cap, configured so that the cap can slide onto a T-shaped, rail protrusion of the lid.

FIG. 10 illustrates a further embodiment, in which an identification cap 60-4 is formed with a recess 60-4A formed into a lateral edge and bottom surface of the cap, configured so that the cap can slide onto a T-shaped, rail protrusion 52-4A of the lid 52-4. Here again, the dimensions of the recess and rail are selected to provide an interference fit so as to secure the cap onto the lid.

It is contemplated that the container and cap may be marketed as a combination, and that the container configured to attach to the cap may be marketed separately from the cap.

Although the foregoing has been a description and illustration of specific embodiments of the subject matter, various modifications and changes thereto can be made by persons skilled in the art without departing from the scope and spirit of the invention.

What is claimed is:

1. An identifier cap for a unitary child-resistant container that includes a vessel portion and a lid portion connected by a living hinge portion, and the lid portion is configured to open via a "squeeze to open" mechanism, wherein the lid is opened from a closed position by a user squeezing the vessel at opposed sides adjacent the lid, the identifier cap comprising:

a surface portion configured to cover at least a portion of the lid portion when attached to the lid;

a cap connection feature configured to engage a corresponding lid connection feature; to establish a connection mechanism for securely attaching the cap to the lid and to resist forces tending to disconnect the cap from the lid, including forces generated by the "squeeze to open" mechanism to open the lid from the vessel, wherein:

the cap connection feature includes a recess space defined by one or more surfaces of the cap and configured to receive a protrusion feature protruding from a lid surface to grip the protrusion feature by interference forces resulting from interference between the one or more cap surfaces and the protrusion feature;

wherein the one or more surfaces include tips of a plurality of ribs extending inwardly from an external skirt portion toward a center of the cap, the ribs terminating short of the cap center to define the recess space, and wherein the plurality of ribs extend radially toward the cap center, a distance between the rib tips defining a dimension smaller than a corresponding dimension of the lid protrusion feature; and wherein the cap is a unitary structure fabricated of a plastic material which is harder than a plastic material from which the container vessel and lid portion are fabricated, such that the cap is configured to fit onto the lid portion with an interference fit between the protrusion feature and the tips of the ribs, such that the protrusion feature will give way and fit tightly into the recess space.

2. The cap of Claim 1, wherein the plurality of ribs consists of eight ribs disposed at 45 degree radial spacing.

3. The cap of claim 1, wherein the plastic material of the cap is a polycarbonate.

4. The cap of claim 1, wherein the cap has an outer periphery configured such that a portion of the cap is received within a recess in the lid.

5. A combination, comprising:

a unitary child-resistant container including a vessel portion and a lid portion connected by a living hinge portion, the lid portion configured to open via a "squeeze to open" mechanism, wherein the lid is opened from a closed position by a user squeezing the vessel at opposed sides adjacent the lid;

the lid portion comprising a lid connection feature including a protrusion feature protruding from a lid surface, and wherein the lid further includes a recess defined by a peripheral wall and the lid surface;

a separate identifier cap configured for attachment to the lid portion, the cap comprising:

a surface portion configured to cover at least a portion of the lid portion when attached to the lid;

a cap connection feature configured to engage the lid connection feature, the cap connection feature including a recess space defined by tips of a plurality of ribs extending inwardly from an external skirt portion toward a center of the cap, and wherein the protrusion feature enters the recess space when the cap is attached to the lid and is gripped by interference forces resulting from interference between the rib tips and the protrusion feature, and wherein the cap has an outer periphery configured such that a portion of the cap is received within the lid recess as the protrusion engages the rib tips;

wherein the plurality of ribs extend radially toward the cap center;

wherein the cap is a unitary structure fabricated of a first plastic material, the container vessel and lid portion are fabricated of a second plastic material, and the first plastic material is harder than the second plastic material; and wherein the lid connection feature and the cap connection feature are configured to form a connection mechanism for securely attaching the cap to the lid portion, rigidifying the lid portion and increasing robustness of the connection between the lid portion and the cap against forces tending to disconnect the cap from the lid, including forces generated by the "squeeze to open" mechanism to open the lid portion from the vessel portion.

6. The combination of claim 5, wherein the plurality of ribs consists of eight ribs disposed at 45 degree radial spacing.

7. The combination of claim 5, wherein the first material is a polycarbonate, and the second material is polypropylene.

8. The combination of claim 5, wherein the cap is a first color, and the container is a second color different from the first color.

9. A plastic unitary child-resistant container, including a vessel portion and a lid portion connected by a living hinge portion, the lid portion configured to open via a "squeeze to open" mechanism, wherein the lid portion is opened from a closed position by a user squeezing the vessel at opposed sides adjacent the lid, the container further characterized in that; the lid portion includes a lid recess defined by a peripheral wall and a lid surface; the lid portion comprises a lid connection feature configured to engage a corresponding cap connection feature in a separate identifier cap to securely attach the cap to the lid by an interference fit and to resist forces tending to disconnect the cap from the lid, including forces generated by the "squeeze to open" mechanism to open the lid from the vessel; the container fabricated of a plastic material softer than a cap material of the cap connection feature; wherein the lid connection feature includes a protrusion feature protruding from the lid surface and extending above a surface of the outer periphery of the lid portion, and wherein the protrusion feature is configured to enter a recess space in the identifier cap defined by a plurality of ribs extending inwardly from a cap edge radially toward a cap center, and the lid portion is configured such that a portion of the cap is received within the recess space as the protrusion feature engages the cap.

* * * * *